US005410812A

United States Patent [19]

Althaus

[11] Patent Number: 5,410,812

[45] Date of Patent: May 2, 1995

[54] RAZOR HEAD OF A WET RAZOR

[75] Inventor: Wolfgang Althaus, Wuppertal, Germany

[73] Assignee: Warner-Lambert Company, Morris Plains, N.J.

[21] Appl. No.: 33,305

[22] Filed: Mar. 15, 1993

[30] Foreign Application Priority Data

Mar. 13, 1992 [GB] United Kingdom ..... 9205547

[51] Int. Cl.[6] ..... B26B 21/14

[52] U.S. Cl. ..... 30/77; 30/50

[58] Field of Search ..... 30/27, 32, 41, 50, 71, 30/77, 78, 346.5, 346.8

[56] References Cited

U.S. PATENT DOCUMENTS

| | | | |
|---|---|---|---|
| 4,094,066 | 6/1978 | Daniel, Jr. | 30/346.58 |
| 4,170,821 | 10/1979 | Booth | 30/41 |
| 4,875,287 | 10/1989 | Creasy | 30/41 |
| 5,063,668 | 11/1991 | Althaus | 30/50 |
| 5,063,669 | 11/1991 | Althaus . | |
| 5,090,124 | 2/1992 | Althaus | 30/78 |

FOREIGN PATENT DOCUMENTS

| | | |
|---|---|---|
| 486390 | 2/1976 | Australia . |
| 0389007 | 9/1990 | European Pat. Off. . |
| 0453718 | 2/1991 | European Pat. Off. . |
| 2367580 | 5/1978 | France . |
| 1251304 | 10/1971 | United Kingdom . |
| 2087288 | 5/1982 | United Kingdom . |

*Primary Examiner*—Richard K. Seidel
*Attorney, Agent, or Firm*—Robert W. Becker & Associates

[57] ABSTRACT

A razor head having a plastic body with a rear cover and a front guardbar that define surface points for engaging the skin of a user. A razor blade unit is disposed on a support of the body and has at least one cutting edge. A series of strands extend over and perpendicular to the cutting edge, which protrudes by at least 0.02 mm beyond a tangent plane formed by the skin-engaging surface points of the guardbar and the cover.

12 Claims, 6 Drawing Sheets

RAZOR HEAD OF A WET RAZOR

BACKGROUND OF THE INVENTION

The present invention relates to a razor head, and especially a razor blade unit, disposed at the front end of a handle of a wet razor. A razor blade means in the form of a single or double razor blade is disposed in a plastic body. In the vicinity of the upper side of the razor head that defines a surface for engaging the skin of a user, protecting strands extend over the cutting edges of the razor blade means at a distance from one another and parallel to the direction of shaving.

Various embodiments of wet or safety razors are known. In each case, disposed at the front end of a handle is a razor head that carries the single or double razor blade. The razor head can be integrally formed with the handle as a molded plastic part. If the razor head is separate from the handle and is to be secured thereto in an exchangeable manner via an appropriate mechanism, it is designated as a so-called razor blade unit, with a single or double razor blade being fixedly embedded in a plastic housing.

A razor head in the form of such a razor blade unit is disclosed in EP 0389007. A wire having a number of adjacent windings is wound around the plastic body in which the double razor blade is embedded. In the vicinity of that surface of the razor blade unit that engages the skin of a user, the individual windings extend at a distance from one another and parallel to the direction of shaving, while at the underside of the plastic body the windings extend at an angle. This protective wire winding significantly improves the shaving characteristics. For example, the wire prevents the formation of folds or bulges of the skin, so that injury to the skin can also be prevented in areas not easily visible during shaving.

Furthermore, the wire reduces the actual shaving resistance, since it reduces the frictional forces. Finally, the protective wire prevents the user from accidentally cutting himself during improper handling of the razor blade unit.

During testing of such wire wound blade units it has been discovered that a comfortable and close shave is not always achieved. Some blade units would have the required comfort and safety but would produce an insufficiently close shave. Also, some other blade units would produce a sufficiently close shave but not be sufficiently safe and comfortable. The comfort and safety provided by the wire strands need to be carefully balanced with the requirement for a close and effective shave. The correct balance needs to be achieved consistently for mass produced blade units. The present invention provides a solution to this problem by careful control of the shaving geometry of the razor head.

SUMMARY OF THE INVENTION

Pursuant to one preferred specific embodiment of the present invention, the protective strands are fixedly attached to the blade unit so that there is no risk of sideways movement of the wires during use.

If a double razor blade is provided, it is proposed pursuant to a further specific embodiment that the two razor blades be secured to both sides of a spacer that is disposed between them, with the thus-formed razor blade/spacer/razor blade unit essentially being inserted from above onto a platform or support means of the plastic body. The advantages mentioned in connection with a single razor blade also apply to this embodiment.

The razor head has a rear cover and a forward guardbar, which is preferably provided with a stepped longitudinal profiling. It is proposed pursuant to a further specific embodiment of the present invention that in the vicinity of the guardbar and the cover, the protective strands be guided below these components and be covered thereby. Thus, the protective strands extend between the guardbar or cover and the actual plastic body with its blade support means. Alternatively, the wires can be embedded in the guardbar and cover parts. As a consequence of both of these configurations, the function of the forward guardbar, especially with its stepped longitudinal profiling, is not reduced by the friction-reducing strand portions, since the forward guardbar is particularly required for prestressing the skin. The same applies to the function of the cover, which is not adversely affected by having the protecting strands extending thereon.

In a preferred specific embodiment of this concept, the guardbar and the cover are interconnected by side walls, while leaving a central opening in the region of the cutting edge or edges of the razor blade means. The thus-formed upper part of the plastic body is placed upon the base member of the plastic body with its razor blade means including the protective strands that is secured to a support means of the base member, whereupon the upper part is securely connected to the base member. Thus, as a consequence of this one-piece upper part, which is formed from the forward guardbar, the rear cover, and the side strips, a simple assembly of the razor head, and in particular of the razor blade unit, is provided. After the single or in particular double razor blade is secured to the support means of the base member, it is merely necessary to insert the upper part essentially from above onto the base member and to securely connect it thereto. This can be effected, for example, in an interlocking manner or in any other suitable fashion.

The objective of the invention is to provide a razor head which produces a comfortable and safe shave as well as a close and effective shave. The strands are critical to achieving this objective. It is also critical that the spacing between the strands and the thickness of the strands are neither too large nor too small. If the spacing is too large or the thickness too small then the desired safety and comfort will not be achieved. If the spacing is too small and the thickness too large then the desired closeness of the shave will not be achieved.

Also critical to the balance between closeness and safety is the position of the blades with respect to the skin-engaging surfaces, in particular of the guardbar and the cover. This is dependent on three factors, namely the protrusion, the tangent length and the shaving angle. The protrusion is the distance which the cutting edges protrude beyond the tangent plane formed by the first skin engaging points on the guardbar and cover. If there are two blades, each can have a different protrusion.

The tangent length can also be different for each of the blades. For the lower blade the tangent length is the distance between the tangent point on the guardbar and the cutting edge of the lower blade. For the upper blade the tangent length is the distance between the cutting edge of the lower blade and the cutting edge of the upper blade. The shaving angle is the angle between the plane of the blades and the tangent plane formed by the skin engaging points.

In a razor head according to the present invention the protrusion is in the range of 0.02 mm to 0.4 mm, the shaving angle is in the range 15° to 30°, and the tangent length is in the range of 1 mm to 5 mm. In a conventional blade unit if the protrusion is too great then the tendency to shave too close and to cause nicking is greatly increased. Equally, a greater tangent length improves the closeness of the shave but increases the risk of folds or bulges of skin penetrating between the guardbar and blades, which increases the risk of accidental cutting. When protective strands are used the problem of folds or bulges is removed and it is possible to increase the tangent length.

The objective of the invention is to provide a razor head which provides a consistently safe and comfortable shave as well as an effective and close shave.

BRIEF DESCRIPTION OF THE DRAWINGS

This objective, and other objectives and advantages of the present invention, will appear more clearly from the following specification in conjunction with the accompanying schematic drawings, in which.

DESCRIPTION OF PREFERRED EMBODIMENTS

Figure 1:
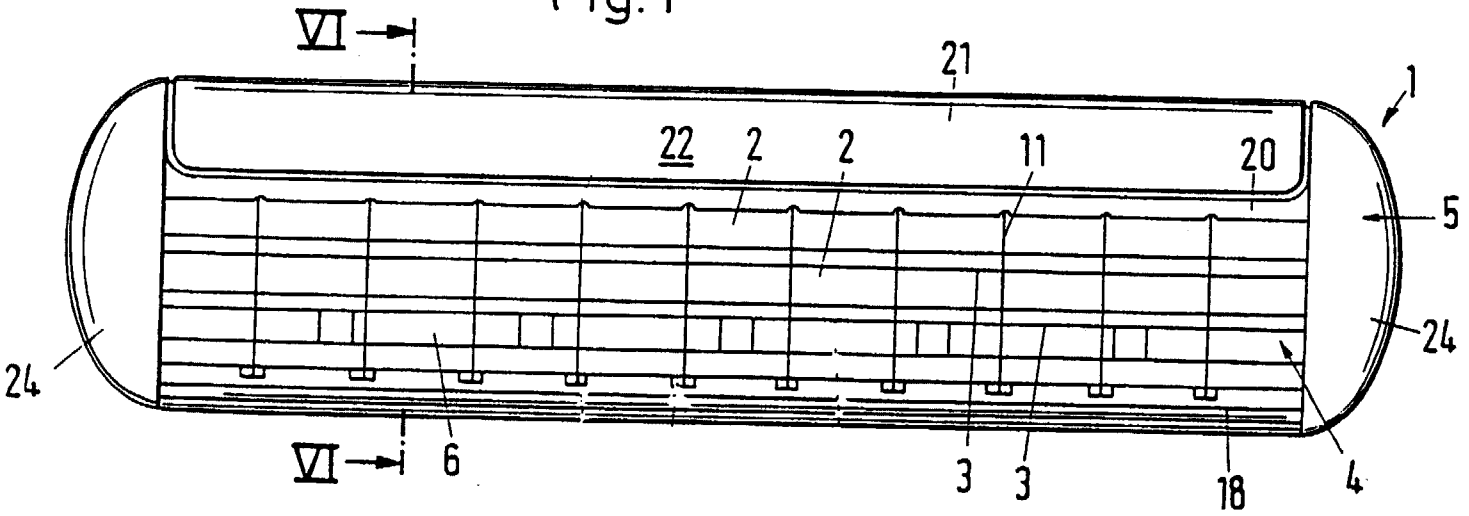
FIG. 1 is a top view of a first exemplary embodiment of the inventive razor head in the form of a razor blade unit of a wet razor.
Figure 2:
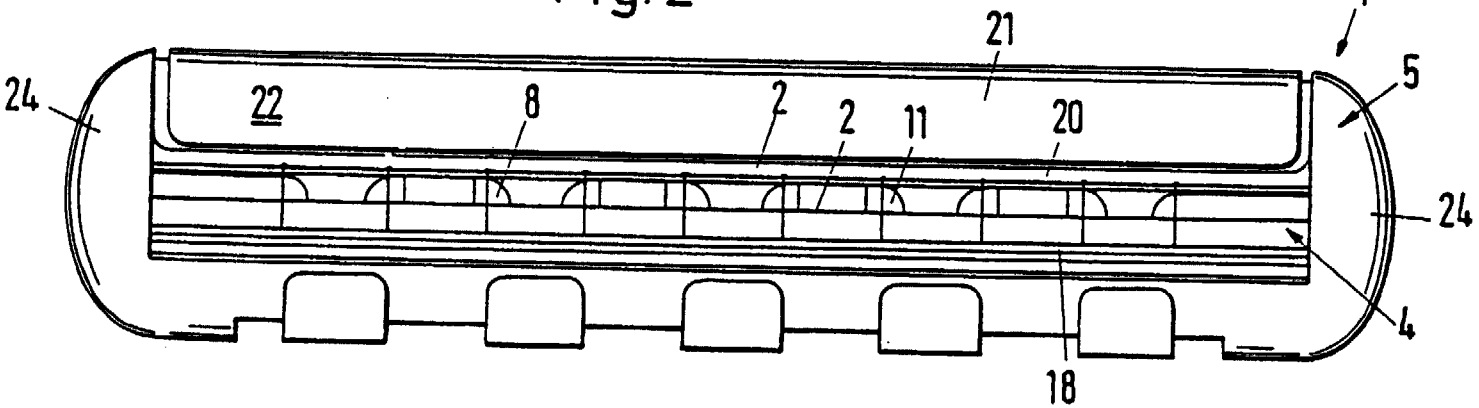
FIG. 2 is a front view of the razor blade unit of FIG. 1.
Figure 3:
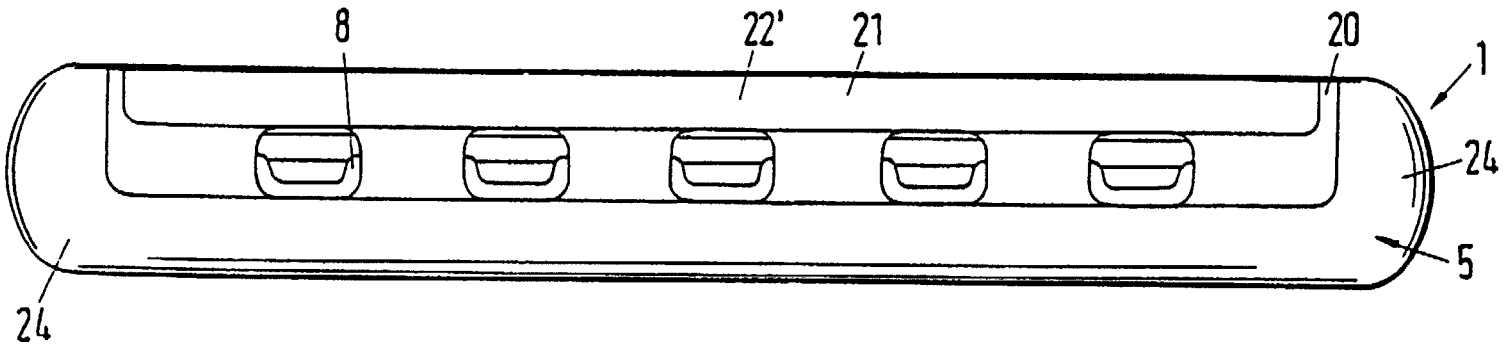
FIG. 3 is a rear view of the razor blade unit of FIG. 1.
Figure 4:
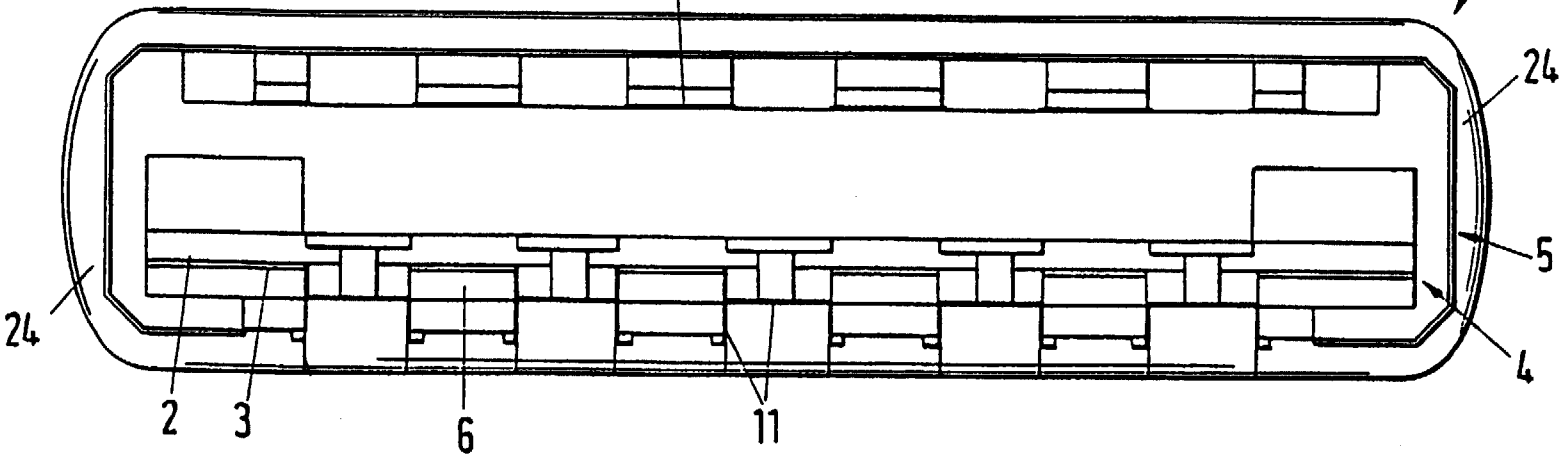
FIG. 4 is a bottom view of the razor blade unit of FIG. 1.
Figure 6:
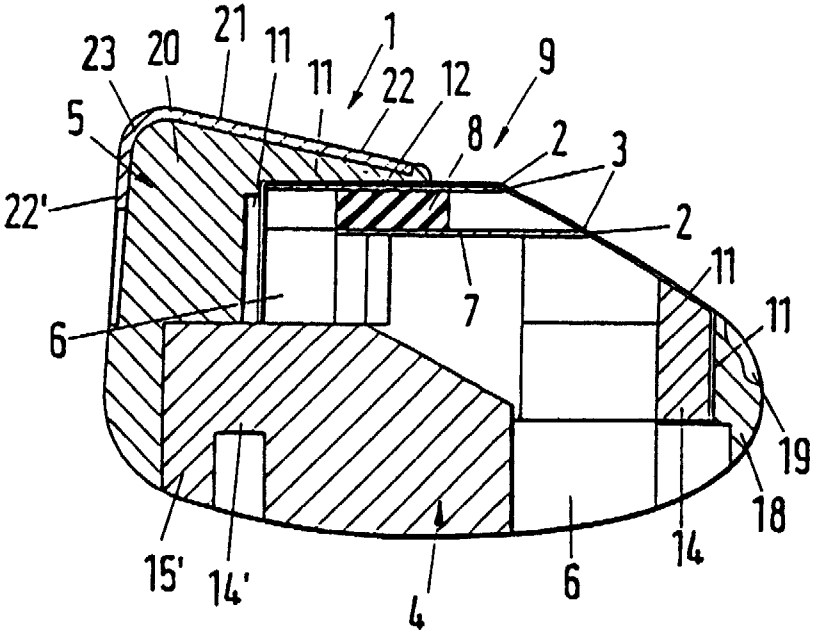
FIGS. 6 and 6*a* are enlarged cross-sectional views taken along the line VI—VI in FIG. 1.
Figure 5:
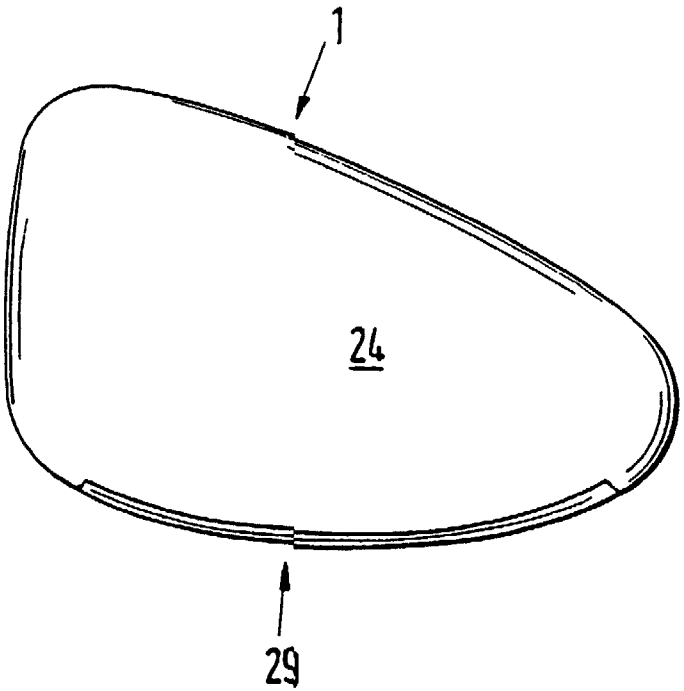
FIG. 5 is an enlarged side view of the razor blade unit of FIG. 1.
Figure 6A:
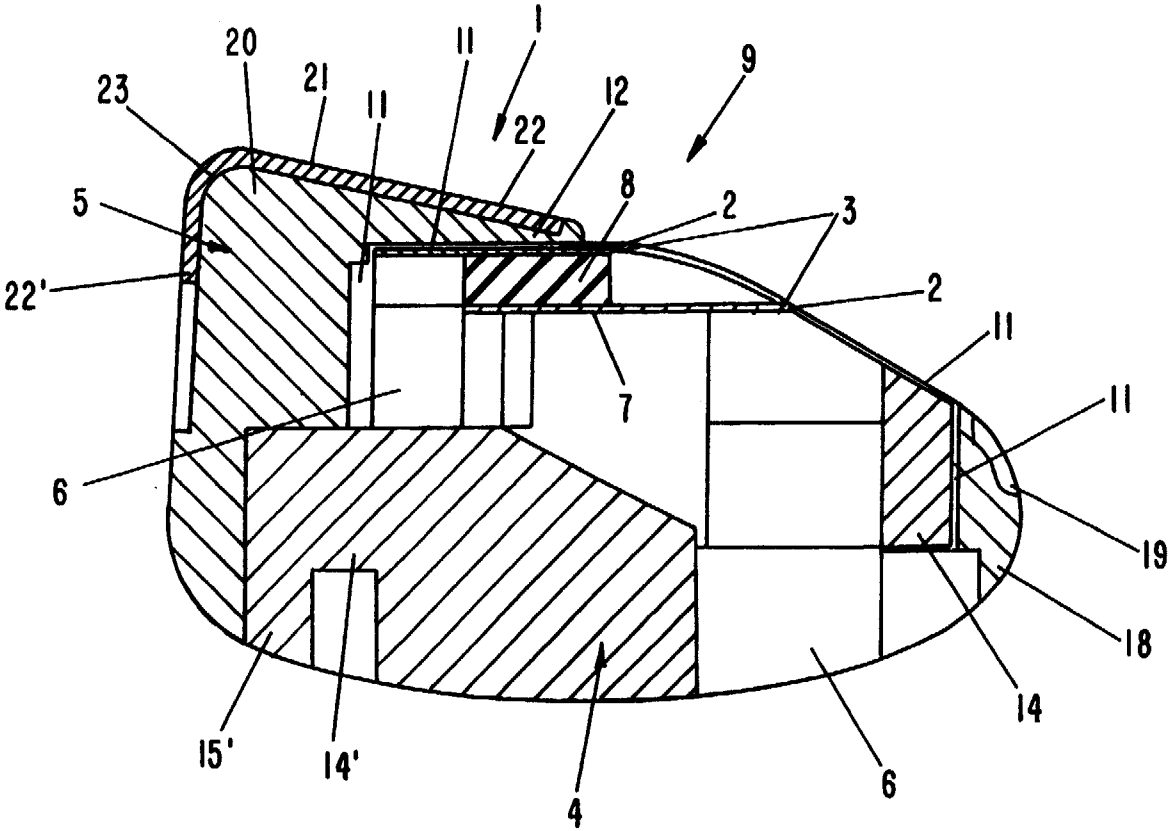
Figure 7:
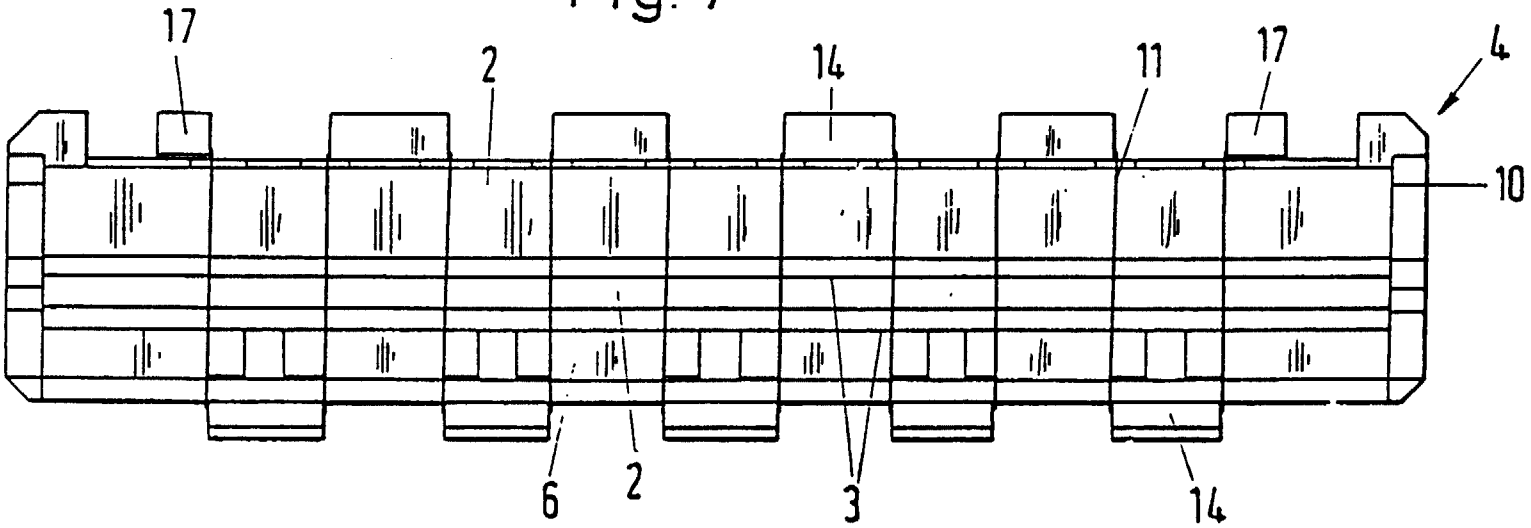
FIG. 7 is a top view of the base member of the razor blade unit without the upper part.
Figure 8:
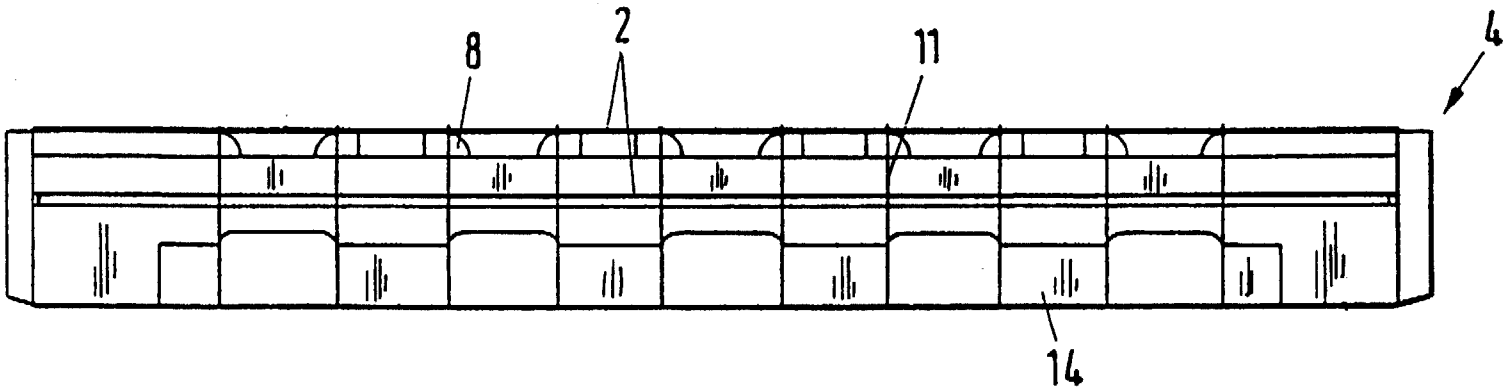
FIG. 8 is a front view of the base member.

Referring now to the drawings in detail, the illustrated razor head, which is in the form of a so-called razor blade unit for a wet or safety razor, and which can be secured to the front end of a non-illustrated handle, comprises a plastic body 1 in which are disposed two razor blades 2, the cutting edges 3 of which extend parallel to one another and are offset one behind the other.

The plastic body 1 comprises a base member 4 that is provided with the razor blades 2, as well as an upper part 5 that is placed upon the base member 4.

The base member 4 of the plastic body 1 is provided with through slots 6 that are primarily disposed in the interior thereof. On the upper side, the base member 4 defines a platform or support means 7 for the razor blades 2. For this purpose, a spacer 8 is sandwiched between the two razor blades 2, which are securely connected to the spacer 8. These components thus form a razor blade/spacer/razor blade unit 9, which is placed from above upon the support means 7 of the base member 4. For this purpose, the spacer 8 comprises projections 17 which extend from the rear and each end of the spacer 8 and which are received in recesses or slots 10 in the sides of the base member 4. The projections at each end of the spacer 8 serve to locate the blade/-spacer/blade unit accurately with respect to the base member 4 and hence to the skin engaging surfaces. It will be appreciated that the blades can be accurately located with respect to the base member by any number of known ways.

The upper part 5 is a one-piece plastic component and is provided with a forward guardbar 18 that extends parallel to the cutting edges 3 of the razor blade 2 and is provided with a stepped longitudinal profiling 19. A protective cover 20 is provided in the back region. This cover is provided at the top with a convexly curved glide or antifriction strip 21 having a first leg 22 and a second leg 22' that is disposed at an acute angle to the first leg 22 and is interconnected therewith via a rounded portion 23. The angle between the two legs 22, 22' of the glide strip 21 can also be 90° or an obtuse angle. The two legs 22, 22' of the glide strip 21 have an essentially planar or slightly convexly curved configuration. It is possible to produce such a glide strip 21 via a special hot mold process. The particular advantage of this glide strip 21 is that it is also more effective at the rear of the razor blade unit. When shaving, the skin is made taut and is pressed in and a bulge is formed at the end of the razor blade unit. Thus, the curved glide strip 21 glides better in this region and thus produces a more comfortable shave.

The forward guardbar 18 and the rear cover 20 are interconnected by side walls 24.

Figure 9:
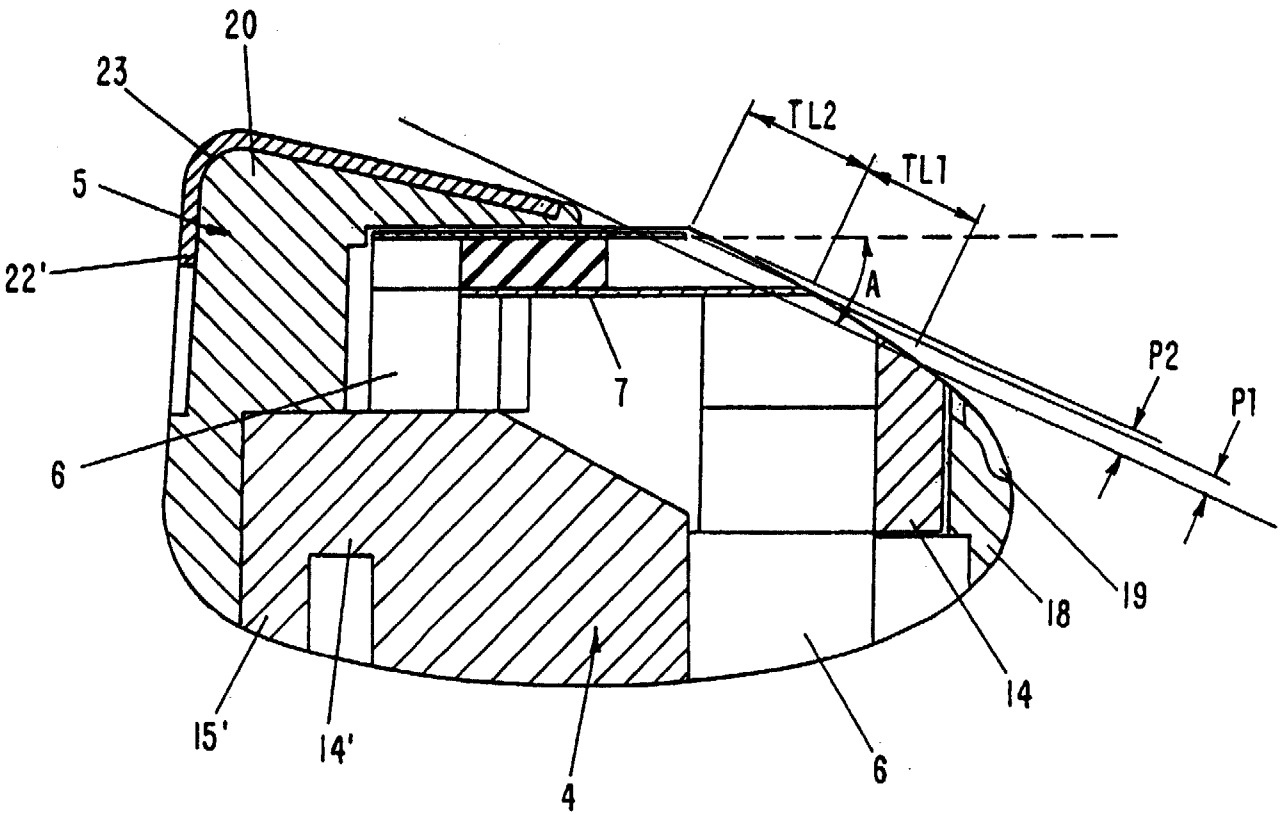
FIG. 9 is an enlarged cross-sectional view showing the shaving geometry.

As shown in FIG. 9, the blades are fixed at a certain shaving angle A with respect to the skin engaging parts of the razor head, and each blade has a certain protrusion P and a tangent length TL. The shaving angle A is the angle between the plane of the blades and the tangent connecting the guardbar 18 and the cover 20. The protrusion of the bottom blade P1 is the distance by which the bottom blade extends beyond the tangent plane connecting the guardbar 18 and the cover 20. The protrusion of the top blade P2 is the distance by which the top blade extends beyond the tangent plane connecting the guardbar 18 and the cover 20. The tangent length of the bottom plate TL1 is the distance between the tangent point on the guardbar 18 and the cutting edge of the bottom blade. The tangent length of the top blade TL2 is the distance between the cutting edges of the two blades.

The blade unit in the illustrated embodiment has a shaving angle A of 22°. The tangent length of the top and bottom blades TL2 and TL1 is 1.5 mm and the protrusions P1 and P2 are 0.075 mm. Successful shaves have also been achieved for particularly heavy beards with protrusions P1 and P2 of 0.1 mm or higher and tangent lengths of 2.0 mm or higher. It will be understood that the razor head may take many forms other than the one described. For example, the protrusions P1 and P2 and the tangent lengths TL1 and TL2 could have different values and the shaving angle could be different for the different blades.

The particular shaving geometry described above will have a combined effect with strands 11 that extend over the cutting edges. In the illustrated embodiment the strands 11 comprise a single piece of wire which is wound around projections 14 on the base member 4. It will be understood that there are many ways of forming and attaching the strands to the blade unit other than this described method, for example welding or gluing wire strands to the blades, or using a single piece net or mesh.

The strands 11 are spaced a preferred distance apart and will be of a preferred thickness in order that the objectives of comfort, safety and closeness are achieved. The preferred spacing is at least 2 mm and the preferred thickness is at least 0.1 mm. In certain applications such as for a heavy beard the preferred spacing and thickness are 3 mm and 0.15 mm respectively.

The present invention is, of course, in no way restricted to the specific disclosure of the specification and drawings, but also encompasses any modifications within the scope of the appended claims.

What I claim is:

1. A razor head, comprising:

a plastic body having a rear cover and a front guardbar that define surface points for engaging the skin of a user, with said plastic body also having a support means;

a razor blade means secured to said support means and having at least one cutting edge; and a series of strands that extend over and perpendicular to said at least one cutting edge of said razor blade means, wherein said at least one cutting edge protrudes by at least 0.02 mm and at most 0.4 mm beyond a tangent plane formed by said skin-engaging surface points of said guardbar and said cover, and wherein said strands are spaced at least 2 mm from one another and have a thickness of at least 0.1 mm.

2. A razor head according to claim 1, wherein said strands are spaced at least 3 mm from one another and have a thickness of at least 0.15 mm.

3. A razor head according to claim 1, wherein said at least one cutting edge protrudes by at least 0.08 mm beyond said tangent plane formed by said skin-engaging surface points of said guardbar and said cover.

4. A razor head according to claim 1, wherein at least one tangent length for said at least one cutting edge is at least 1 mm and at most 5 mm.

5. A razor head according to claim 1, wherein a shaving angle between a plane of said razor blade means and said tangent plane formed by said skin-engaging surface points of said guardbar and said cover is between 15° and 30°.

6. A razor head according to claim 5, wherein said razor blade means comprises a spacer and two razor blades connected to opposite sides of said spacer, which is disposed between them, with each of said razor blades being provided with a cutting edge.

7. A razor head according to claim 6, wherein said two razor blades have different shaving angles.

8. A razor head according to claim 6, wherein said cutting edges of said two razor blades protrude by different magnitudes beyond said tangent plane formed by said skin-engaging surface points of said-guardbar and said cover.

9. A razor head according to claim 8, wherein one of said cutting edges has a negative protrusion.

10. A razor head according to claim 1, wherein said cover is provided with a glide strip.

11. A razor head according to claim 10, wherein said glide strip has a convexly curved outer surface.

12. A razor head according to claim 11, wherein said glide strip has a forward leg and a rear leg that are disposed at an angle to one another and are interconnected via a rounded portion.

* * * * *